US005782619A

United States Patent [19]

Fehlmann

[11] Patent Number: 5,782,619

[45] Date of Patent: Jul. 21, 1998

[54] RADIAL PISTON DISTRIBUTOR FUEL INJECTION PUMP

[75] Inventor: Wolfgang Fehlmann, Stuttgart, Germany

[73] Assignee: Robert Bosch GmbH, Stuttgart, Germany

[21] Appl. No.: 548,844

[22] Filed: Oct. 26, 1995

[30] Foreign Application Priority Data

Oct. 26, 1994 [DE] Germany ..... 44 38 251.0

[51] Int. Cl.[6] ..... F04B 19/02

[52] U.S. Cl. ..... 417/462; 123/450

[58] Field of Search ..... 417/462; 123/495, 123/450

[56] References Cited

U.S. PATENT DOCUMENTS

| | | | |
|---|---|---|---|
| 3,107,661 | 10/1963 | Kemp | 123/450 |
| 3,319,616 | 5/1967 | Gilkin | 123/450 |
| 3,970,414 | 7/1976 | Mowbray | 417/462 |
| 4,040,405 | 8/1977 | Tanaka et al. | 123/450 |
| 4,446,835 | 5/1984 | Mowbray | 123/450 |
| 4,450,813 | 5/1984 | Takano et al. | 123/450 |
| 4,453,896 | 6/1984 | Vilardo et al. | 123/450 |
| 4,572,138 | 2/1986 | Mowbray | 417/462 |
| 4,699,108 | 10/1987 | Ronse et al. | 123/450 |
| 4,711,618 | 12/1987 | Abinett | 123/450 |
| 5,617,826 | 4/1997 | Brandt | 123/450 |

FOREIGN PATENT DOCUMENTS

| | | | |
|---|---|---|---|
| 0381201 | 8/1990 | European Pat. Off. . | |
| 3615286 | 5/1986 | Germany . | |
| 3615286A1 | 12/1986 | Germany . | |
| 2012864 | 12/1978 | United Kingdom . | |
| 2086490 | 5/1982 | United Kingdom | 123/450 |

OTHER PUBLICATIONS

Grainger Catalog, p. 912, 1991.

*Primary Examiner*—Timothy Thorpe
*Assistant Examiner*—Peter G. Korytnyk
*Attorney, Agent, or Firm*—Edwin E. Greigg; Ronald E. Greigg

[57] ABSTRACT

A fuel injection pump, in which there is provided in a distributor of the fuel injection pump, a longitudinal bore which connects a pump working space to a control point on the distributor and which is fashioned in the distributor from one end face of the distributor. For sealingly closing this longitudinal bore, there is provided a pin which is inserted into a transverse bore intersecting the longitudinal bore and which thus has a sealing fit influenced by the pressure in the longitudinal bore.

28 Claims, 2 Drawing Sheets

RADIAL PISTON DISTRIBUTOR FUEL INJECTION PUMP

STATE OF THE ART

The invention proceeds from a fuel injection pump as set forth hereinafter. In such an injection pump known from DE-A1-3,615,286, there is provided as a closing piece for the longitudinal bore emerging coaxially on the end face of the distributor, a screw which is screwed in at that end of the longitudinal bore. This represents a considerable outlay, since the end of the longitudinal bore has to be additionally provided with a thread, into which the screw is screwed. Furthermore, additional safety measures must be provided to ensure that the screw does not come loose during the operation of the fuel injection pump and consequently that the longitudinal channel does not become leaky towards the outside.

ADVANTAGES OF THE INVENTION

In contrast to this, the advantage of the fuel injection pump according to the invention, is that the cylindrical pin inserted transversely to the axis is not loaded in the insertion direction by the pressure engaging on it, so that a loosening of the pin out of its anchoring in the distributor cannot occur as a result of the pressure effect. At the same time, the pin can be pressed into the bore in the usual way with a press fit or, instead or in addition, be adhesively bonded therein. There are at the present time plastic adhesives which bond even smooth grained joints to one another with high strength and which thus guarantee a secure adhesion of the parts on one another, even under dynamic and high load. If the outlay for securing the pin against falling out, which under some circumstances could occur as a result of shaking stress, especially since a fuel injection pump is exposed during operation to considerable vibratory loads, is to be reduced, then the pin can be inserted in a simple way, for example pressed in, and additionally secured by a surrounding part. In a further advantageous embodiment, however, the pin itself also serves as part of a coupling for the rotary drive of the distributor, when the part surrounding the distributor is at the same time a coupling part which is driven by the drive of the fuel injection pump. This achieves a twofold advantage, in that, on the one hand, the pin is secured optimally against falling out and, at the same time, ensures the necessary drive of the distributor. This solution can be adopted in a particularly advantageous way in so-called radial-piston distributor injection pumps, in which the longitudinal channel opens directly into the pump working space at the foot of the distributor and then shortly thereafter emerges on the end face of the distributor and is closed there by means of the transversely inserted pin. The embodiment can also be implemented by a special port which holds the pin in place.

BRIEF DESCRIPTION OF THE DRAWINGS

An exemplary embodiment of the invention is illustrated in the drawing and is explained in more detail in the following description.

DESCRIPTION OF THE EXEMPLARY EMBODIMENT

Figure 1:
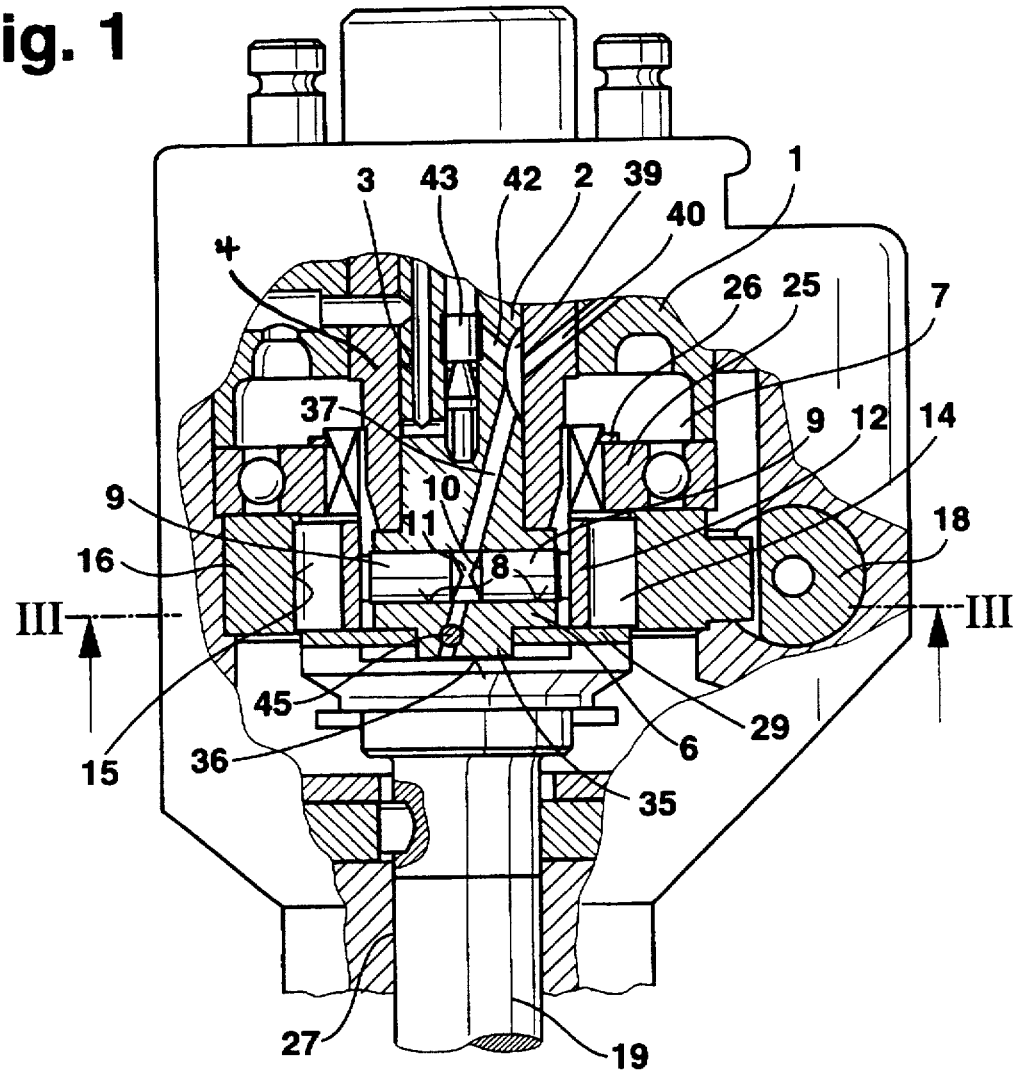
FIG. 1 shows a partial longitudinal section through a fuel injection pump of the radial-piston distributor pump type.
Figure 4:
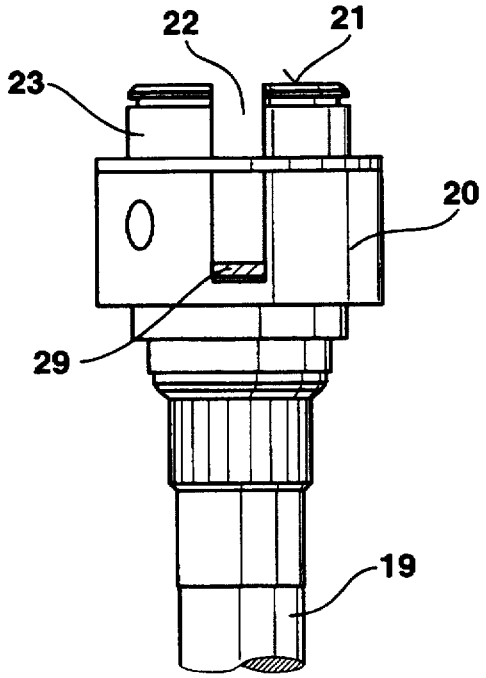
FIG. 4 is a side view of the drive shaft with receptacles for the coupling part.

The invention is illustrated by the example of a radial-piston fuel-distributor injection pump, in which it is employed in a particularly advantageous way. For this purpose, FIG. 1 shows a partial sectional through the parts of such a fuel injection pump which are essential for the use of illustrating the invention. Said fuel injection pump comprises a distributor 2 which is mounted in a cylinder 3 of a cylindrical bush 4 inserted into the housing 1 of the fuel injection pump and projects, with a foot 6 protruding from the cylinder 3, in a fuel-filled interior 7 of the fuel injection pump. Fashioned in this foot are radial bores 8, into which are inserted pump pistons 9 which enclose relative to one another by means of their inner end face 10 a common pump working space 11. At their end in each case projecting from the radial bore 8, a roller shoe 12 bears in each case against the pump piston, each with a roller 14 running on a cam track 15 of a cam ring 16 surrounding the distributor. The cam ring is symmetrical to a radial plane defined by the axes of the pump pistons 9, is essentially stationary and is adjusted in the circumferential direction by means of an injection timer 18 in order to vary the start of the pump piston stroke. The said cam ring is radially mounted with its circumferential surface in the pump housing. In contrast to this, the distributor, together with the roller shoes, constitutes the moved part of the cam drive of the fuel injection pump. In this arrangement, the distributor is driven by a drive shaft 19 of the fuel injection pump which is driven synchronously with the internal combustion engine in a way not shown any further. The said drive shaft 19 has, with its end projecting into the interior 7, a design which is similar to a fork head and which can be seen in more detail in FIG. 4. This design consists of a head 20 having axial longitudinal slots 22 which start from the end face 21 and into which the roller shoes 12 can be inserted from the end face 21 and are guided radially displaceably in the slots. Adjoining the part of the head 20 of wider diameter towards the end face 21 is a part 23 of reduced diameter which serves for receiving a ballbearing 25, as can be seen in FIG. 1. This is secured relative to the head part 20 of wider diameter by means of a retaining ring 26. The drive shaft is consequently guided on one side in a sliding bearing 27 and on the other side in a ballbearing 25.

Figure 3:
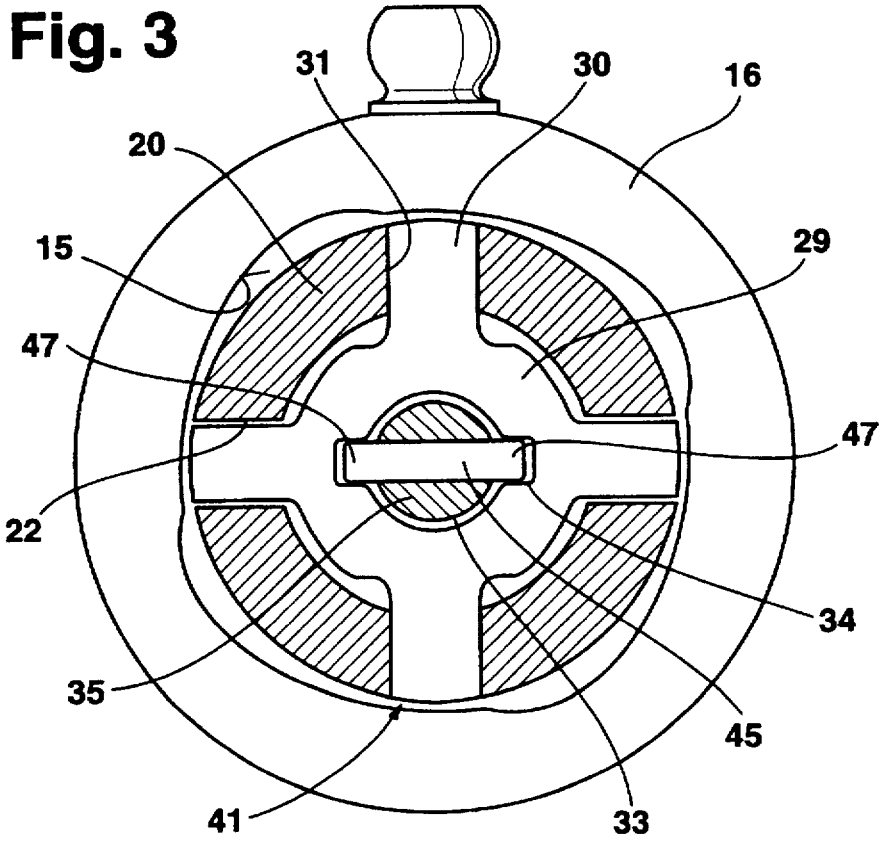
FIG. 3 illustrates a section along the line III—III through the representation of FIG. 1.

Furthermore, for transmitting the rotational movement of the drive shaft to the distributor, there is provided a coupling disk 29 which, as can be seen in FIG. 3, is of star-shaped design with radially projecting webs 30 provided according to the number of longitudinal slots 22 or the number of pump pistons with a roller shoe. The webs have side edges 31 parallel to one another and are guided via these in the slots 22. The coupling disk has in the middle a circular perforation 33, from which extend recesses 34 located diametrically opposite one another. This perforation 33 coaxial relative to the drive shaft serves for receiving a shaft journal 35 at the foot of the distributor. Starting from this foot, there is fashioned in the distributor, on its end face 36, a longitudinal bore 37 which intersects the radial bores 8 in the region of the pump working space 11 and which leads to a control point on the distributor in the form of a distributor groove 39 on the outer surface of the distributor. In each case during a conveying stroke of the pump pistons 9, this distributor groove is alternatively brought into connection with an injection conduit 40 which leads to an injection valve on the associated internal combustion engine. The fuel conveyed by the pump pistons 9 during their inward stroke under the compulsion of the cams 41 of the cam track (see FIG. 3) is in each case to be fed under high pressure to one of these injection conduits. For this purpose, the longitudinal bore 37 is closed in the region of the shaft journal 35, and, in order to generate the high-pressure conveying stroke, a filling and relief conduit 42 starting from the distributor groove 39 is closed by means of a valve member 43 of a solenoid valve not shown any further. To terminate the high-pressure injection, the valve member 43 is opened.

Figure 2:
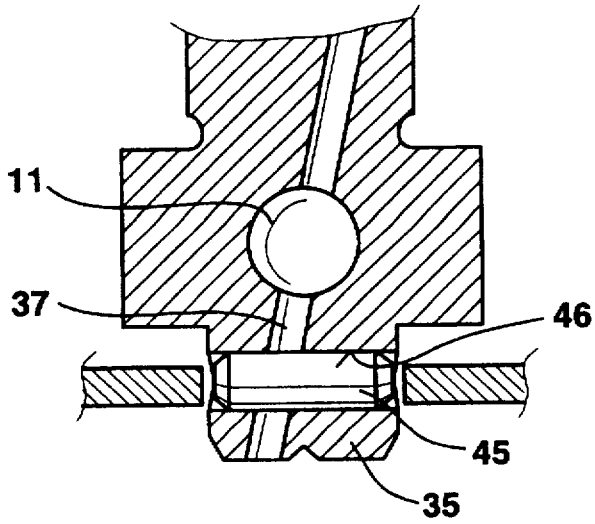
FIG. 2 illustrates a part view in section perpendicularly to FIG. 1.

The closure of the longitudinal bore in the region of the shaft journal takes place by means of a pin 45 which, as can be seen more clearly in FIG. 2, is inserted into a bore 46 extending transversely relative to the longitudinal axis of the distributor. This bore intersects the longitudinal bore 37 over its entire cross section and has a diameter which is at least equal to the diameter of the longitudinal bore 37, but is preferably larger. The pin inserted into this bore thus closes the longitudinal bore 37 in a completely sealing manner. At the same time, the pin 45 is loaded only radially by the high pressure prevailing in the longitudinal bore 37, in such a way that no axial force component which could expel the pin is exerted on it. The forces holding the pin in the bore 46 can thus be low. The pin can be fitted in with a press fit in a known way, but, for the sake of safety, it can also be adhesively bonded in, in which case greater tolerances of fit would be permitted. So that the pin also cannot travel out of the bore 46 as a result of shaking stresses occurring on the distributor pump when it is in operation, in an advantageous additional way the coupling disk 29 is arranged so that it lies in the plane of the longitudinal axis of the pin 45 and with its perforation 33 is directly adjacent to the shaft journal and therefore also to the end faces of the pin 45. The perforation can initially be designed as a perforation matched to the cross-sectional shape of the shaft journal. If the shaft journal is provided, for example, with shaped surfaces, via which it is to be coupled to the coupling disk, the latter carries the same shaped surface in the region of the perforation. Preferably, however, in a development of the embodiment described, the pin 45, in addition to its function of closing the longitudinal axis, can also serve as part of the coupling between the distributor and the drive. In this case, the shaft journal 35 is, for example, round in cross section and the pin is designed so that it is longer than the shaft-journal diameter according to FIG. 3. The parts 47 of the pin 45 which project beyond the shaft journals then engage into the recesses 34 in the coupling disk, in such a way that, with the coupling disk 29 taken up by the slot 22 on the drive shaft 19, the movement of said coupling disk 29 is transmitted to the distributor 2 via the pin 47. This results in an extremely efficient connection between the distributor and its drive and, at the same time, a highly effective and economical connection for closing the longitudinal channel 37 securely relative to the outside.

The foregoing relates to preferred exemplary embodiments of the invention, it being understood that other variants and embodiments thereof are possible within the spirit and scope of the invention, the latter being defined by the appended claims.

I claim:

1. A fuel injection pump comprising a housing, a distributor (2) in said housing which is driven in rotation by a drive shaft (19) of the fuel injection pump and in which is arranged a longitudinal bore (37) which extends essentially in the axial direction of the distributor and connects a high-pressure space (11) in the housing to a control point (39) of the distributors (2) and which is fashioned in the distributor from one end face (36) of the distributor and thereafter is closed relative to an outside by means of a closing piece (45), wherein there is provided as a closing piece a cylindrical pin (45) which is fitted in a manner secured against displacement into a bore (46) which extends transversely relative to an axis of the distributor (2) and intersects the longitudinal bore (37) inwardly of said end face (36) and the diameter of said closing piece (45) is at least as large as the diameter of the longitudinal bore.

2. The fuel injection pump as claimed in claim 1, wherein the pin (45) is pressed into the bore (46).

3. The fuel injection pump as claimed in claim 2, wherein the pin (45) is adhesively bonded into the bore (46).

4. The fuel injection pump as claimed in claim 3, wherein there is provided in a radial plane of the distributor axis a coupling disk (29) which surrounds the distributor (2) and which opposes a displacement of the pin (45) out of the bore (46).

5. The fuel injection pump as claimed in claim 2, wherein there is provided in a radial plane of the distributor axis a coupling disk (29) which surrounds the distributor (2) and which opposes a displacement of the pin (45) out of the bore (46).

6. The fuel injection pump as claimed in claim 2, wherein the pump pistons (9) of the fuel injection pump are arranged in radial bores (8) which are oriented radially to the axis of the distributor (2) and which between their end faces pointing to one another enclose, in the distributor (2), a common pump working space (11) connected as a pressure space to the control point (39) by means of the longitudinal bore (37) which intersects the working space and which has an outlet on the end face (36) of the distributor (2) in a shaft journal (35) of the distributor.

7. The fuel injection pump as claimed in claim 6, wherein the shaft journal (35) is surrounded by a coupling disk (29) moved together with the distributor.

8. The fuel injection pump as claimed in claim 7, wherein the coupling disk (29) is provided with at least one recess (34) pointing radially relative to the shaft journal (35) and into which engages at least one end of the pin (45) projecting from the shaft journal (35), via which end the distributor (2) is connected by means of the coupling disk (29) to the drive (19) of the distributor (2).

9. The fuel injection pump as claimed in claim 1, wherein the pin (45) is adhesively bonded into the bore (46).

10. The fuel injection pump as claimed in claim 3, wherein there is provided in a radial plane of the distributor axis a coupling disk (29) which surrounds the distributor (2) and which opposes a displacement of the pin (45) out of the bore (46).

11. The fuel injection pump as claimed in claim 9, wherein the pump pistons (9) of the fuel injection pump are arranged in radial bores (8) which are oriented radially to the axis of the distributor (2) and which between their end faces pointing to one another enclose, in the distributor (2), a common pump working space (11) connected as a pressure space to the control point (39) by means of the longitudinal bore (37) which intersects the working space and which has an outlet on the end face (36) of the distributor (2) in a shaft journal (35) of the distributor.

12. The fuel injection pump as claimed in claim 11, wherein the shaft journal (35) is surrounded by a coupling disk (29) moved together with the distributor.

13. The fuel injection pump as claimed in claim 12, wherein the coupling disk (29) is provided with at least one recess (34) pointing radially relative to the shaft journal (35) and into which engages at least one end of the pin (45) projecting from the shaft journal (35), via which end the distributor (2) is connected by means of the coupling disk (29) to the drive (19) of the distributor (2).

14. The fuel injection pump as claimed in claim 1, wherein there is provided in a radial plane of the distributor axis a coupling disk (29) which surrounds the distributor (2) and which opposes a displacement of the pin (45) out of the bore (46).

15. The fuel injection pump as claimed in claim 14, wherein the pin (45) is longer than the bore (46) and, with at least one part (47) that projects from the bore, engages as a driver into a recess (34) of the coupling disk (29) and is adjacent to a circumference of the distributor and for rotation, the distributor (2) is coupled indirectly to the drive shaft (19) of the fuel injection pump.

16. The fuel injection pump as claimed in claim 15, wherein opposite ends of the pin (45) extends for the same length from the bore (46) and engages a corresponding recess (34) of the coupling disk (29).

17. The fuel injection pump as claimed in claim 16, wherein the pump pistons (9) of the fuel injection pump are arranged in radial bores (8) which are oriented radially to the axis of the distributor (2) and which between their end faces pointing to one another enclose, in the distributor (2), a common pump working space (11) connected as a pressure space to the control point (39) by means of the longitudinal bore (37) which intersects the working space and which has an outlet on the end face (36) of the distributor (2) in a shaft journal (35) of the distributor.

18. The fuel injection pump as claimed in claim 17, wherein the shaft journal (35) is surrounded by the coupling disk (29) moved together with the distributor.

19. The fuel injection pump as claimed in claim 18, wherein the coupling disk (29) is provided with at least one recess (34) pointing radially relative to the shaft journal (35) and into which engages at least one end of the pin (45) projecting from the shaft journal (35), via which end the distributor (2) is connected by means of the coupling disk (29) to the drive (19) of the distributor (2).

20. The fuel injection pump as claimed in claim 15, wherein the pump pistons (9) of the fuel injection pump are arranged in radial bores (8) which are oriented radially to the axis of the distributor (2) and which between their end faces pointing to one another enclose, in the distributor (2), a common pump working space (11) connected as a pressure space to the control point (39) by means of the longitudinal bore (37) which intersects the working space and which has an outlet on the end face (36) of the distributor (2) in a shaft journal (35) of the distributor.

21. The fuel injection pump as claimed in claim 20, wherein the shaft journal (35) is surrounded by the coupling disk (29) moved together with the distributor.

22. The fuel injection pump as claimed in claim 21, wherein the coupling disk (29) is provided with at least one recess (34) pointing radially relative to the shaft journal (35) and into which engages at least one end of the pin (45) projecting from the shaft journal (35), via which end the distributor (2) is connected by means of the coupling disk (29) to the drive (19) of the distributor (2).

23. The fuel injection pump as claimed in claim 14, wherein the pump pistons (9) of the fuel injection pump are arranged in radial bores (8) which are oriented radially to the axis of the distributor (2) and which between their end faces pointing to one another enclose, in the distributor (2), a common pump working space (11) connected as a pressure space to the control point (39) by means of the longitudinal bore (37) which intersects the working space and which has an outlet on the end face (36) of the distributor (2) in a shaft journal (35) of the distributor.

24. The fuel injection pump as claimed in claim 23, wherein the shaft journal (35) is surrounded by the coupling disk (29) moved together with the distributor.

25. The fuel injection pump as claimed in claim 24, wherein the coupling disk (29) is provided with at least one recess (34) pointing radially relative to the shaft journal (35) and into which engages at least one end of the pin (45) projecting from the shaft journal (35), via which end the distributor (2) is connected by means of the coupling disk (29) to the drive (19) of the distributor (2).

26. The fuel injection pump as claimed in claim 1, wherein the pump pistons (9) of the fuel injection pump are arranged in radial bores (8) which are oriented radially to the axis of the distributor (2) and which between their end faces pointing to one another enclose, in the distributor (2), a common pump working space (11) connected as a pressure space to the control point (39) by means of the longitudinal bore (37) which intersects the working space and which has an outlet on the end face (36) of the distributor (2) in a shaft journal (35) of the distributor.

27. The fuel injection pump as claimed in claim 26, wherein the shaft journal (35) is surrounded by a coupling disk (29) moved together with the distributor.

28. The fuel injection pump as claimed in claim 27, wherein the coupling disk (29) is provided with at least one recess (34) pointing radially relative to the shaft journal (35) and into which engages at least one end of the pin (45) projecting from the shaft journal (35), via which end the distributor (2) is connected by means of the coupling disk (29) to the drive (19) of the distributor (2).

* * * * *